United States Patent [19]

Center

[11] Patent Number: 4,709,441

[45] Date of Patent: Dec. 1, 1987

[54] ESCALATOR SWEEPING MECHANISM

[75] Inventor: Gene R. Center, San Diego, Calif.

[73] Assignee: R. E. Baker Company, Inc., Santa Ana, Calif.

[21] Appl. No.: 934,684

[22] Filed: Nov. 24, 1986

[51] Int. Cl.[4] ..... A47L 5/38

[52] U.S. Cl. ..... 15/301; 15/256.5; 15/354

[58] Field of Search ..... 15/301, 4, 21 B, 354, 15/302, 256.5

[56] References Cited

U.S. PATENT DOCUMENTS

| | | | |
|---|---|---|---|
| 2,060,491 | 11/1936 | Dunlip | 15/256.5 X |
| 3,273,193 | 9/1966 | Soderholm et al. | 15/320 |
| 3,584,329 | 6/1971 | Cravits | 15/302 |
| 3,869,749 | 3/1975 | London et al. | 15/302 |
| 4,514,872 | 5/1985 | Hopkins | 15/301 X |
| 4,664,719 | 5/1987 | Mizutani | 15/256.5 X |

*Primary Examiner*—Chris K. Moore

*Attorney, Agent, or Firm*—I. Michael Bak-Boychuk

[57] ABSTRACT

A sweeper assembly for use with escalators includes a frame having a pivoted end structure on which a weighted bar is fixed to press a polishing pad adjacent a bristle element against the moving surfaces of the escalator. A vacuum cleaner is then rendered operative to draw the debris thus loosened into a nozzle deployed adjacent the bristle element.

4 Claims, 3 Drawing Figures

FIG. 1
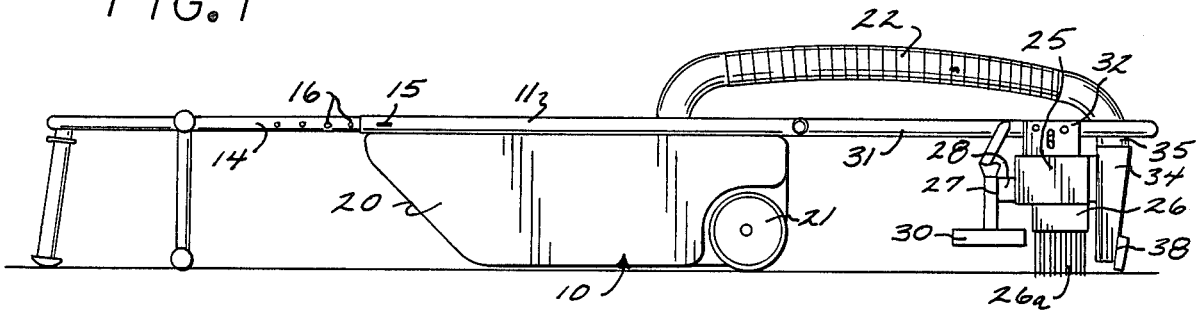
FIG. 2
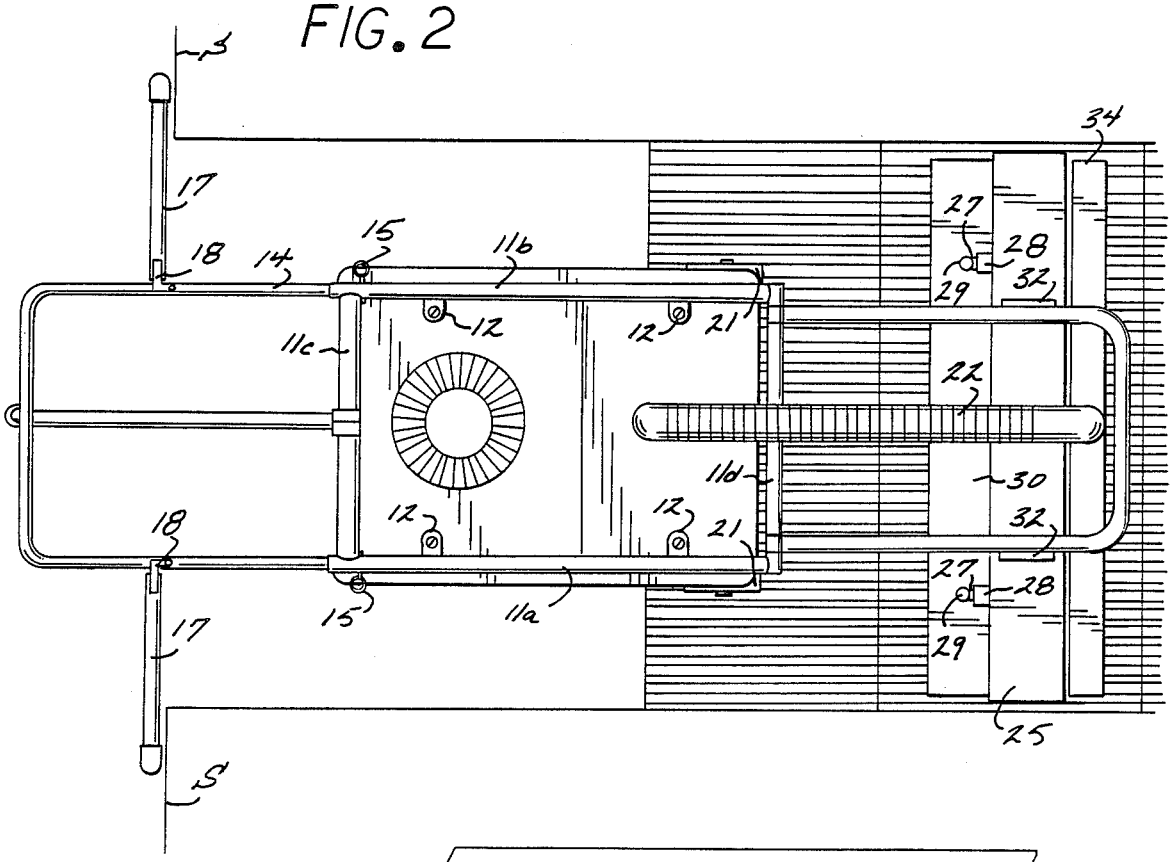
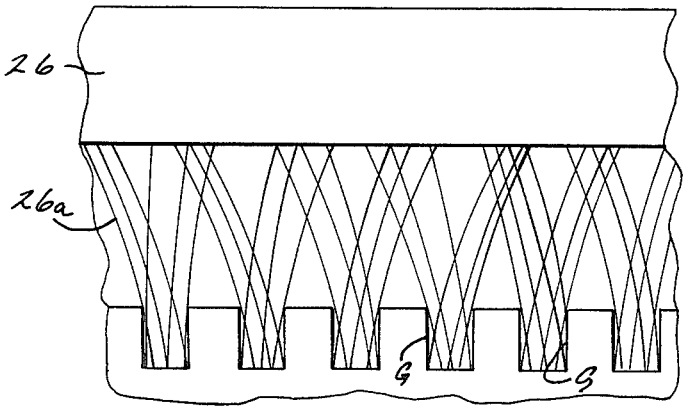
FIG. 3

ESCALATOR SWEEPING MECHANISM

BACKGROUND OF THE INVENTION

1. Field of the Invention

The present invention relates to automated sweeping systems and more particularly to sweeping mechanisms conformed for use on escalators.

2. Description of the Prior Art

The movement of people in large, public installations often entails mechanized conveyance such as elevators, moving walkways and escalators. Of these the escalator is now particularly favored for its inherent user convenience and control simplicity. As a consequence public structures like shopping centers, theaters, transportation centers and the like often include one or more escalators for conveying pedestrian traffic between levels.

Characteristically, an escalator includes a continuous loop of stairs mechanically advanced while presenting one segment for the pedestrian traffic. As result both the receiving and off loading ends of the exposed loop segment require convenient merging with the adjacent stationary portions of the structure. The preferred mechanism for accommodating this transition from a stationary platform to the moving surface entails a set of parallel depressions or grooves in the surface of each stair which fit between a set of fingers at each stationary end. Thus, at the receiving end the stairs emerge sequentially from underneath the finger structure to pick up the user. Similarly on the off-loading end the stairs submerge under the interspaced fingers.

The spacing and depth of the grooves on each stair consequently are dictated by the material strength and the pedestrian footwear, and the grooves therefore are relatively closely spaced and of substantial depth. In this form the grooves become effective traps for dirt and debris which is particularly acute during periods of extreme use.

As result cleaning techniques of minimal use disruption have been sought in the past and it is one such technique that is disclosed herein.

SUMMARY OF THE INVENTION

Accordingly, it is the general purpose and object of the present invention to provide a sweeper assembly conformed for use with an escalator.

Other objects of the invention are to provide a sweeper assembly which is conveniently transported and fixed to an escalator.

Yet further objects of the invention are achieved in a transportable sweeper assembly which, with minimal attendance, collects and removes by vacuum the debris on an escalator.

Briefly, these and other objects are accomplished within the present invention by providing a wheel supported frame pivotally engaged at the front to a carrier assembly from which a transverse brush combination depends. The pivotal motion of the carrier assembly extends over a semicircular arc from a stored position on the frame to a deployed position supported by the brush. The brush combination includes a weighted transverse piece adjustably secured to the carrier assembly to present a bristle strip mounted thereon. A vacuum nozzle is then fixed along one side of the transverse piece with a buffing pad adjustably fixed to the other side. Thus, the extension of the bristles into the grooves of each moving stair surface is controlled by the adjustment of the pad and can thus be conformed for the various groove configurations. In a similar manner the deployment of the nozzle is adjustable to control the contact of a bristle screen fixed thereto against the stair surface.

The other end of the frame assembly forms an extendable handle provided with two laterally pivotal braces which when deployed engage the side surfaces of the escalator. A commercially available vacuum cleaner may then be fixed within the frame assembly and may thus be transported therewith, communicating by a suction hose with the nozzle.

In this manner a transportable cleaning combination is obtained which is easily brought to the receiving end of the escalator and which effects full cleaning in a single pass of the escalator loop. Of course, the transverse dimension of the brush combination may be selected to fit the escalator width and a single adjustment of the various elements of the combination will accommodate the common features of each escalator in particular public structures.

BRIEF DESCRIPTION OF THE DRAWINGS

FIG. 1 is a side view of the inventive sweeper deployed for use;

FIG. 2 is a top view of the inventive sweeper shown in FIG. 1; and

FIG. 3 is a front view, in partial section, of the brush assembly of the inventive sweeper disclosed herein.

DESCRIPTION OF THE PREFERRED EMBODIMENT

As shown in FIGS. 1–3 the inventive cleaning assembly, generally designated by the numeral 10, comprises a tubular frame 11 of substantially rectangular construction including two lateral pieces 11*a* and 11*b* fixed to the ends of a fore and an aft piece 11*c* and 11*d*. In this form frame 11 may be secured to a 11d. In this form frame 11 may be secured to a conventional vacuum cleaner 20 and includes for the purposes of such attachment a plurality of securing tabs 12. As is customary, the vacuum cleaner 20 is provided with at least two wheels 21 for mobility and a suction hose 22 for operation. Thus the vacuum cleaner provides an undercarriage for frame 11 and any articles engaged thereto. Moreover, a U-shaped forward piece 14 is telescopically received in the ends of the side pieces 11*a* and 11*b* at selected increments of insertion determined by lock pins 15 which are received in the common interior of a plurality of bores 16 in the forward piece.

Consequently, forward piece 14 is deployable at various increments of extension relative frame 11 thus fixing the relative dimension of two lateral arms 17 pivoted from the sides of piece 14. The pivotal motion of each arm 17 is limited by an offset hinge mechanism 18 to either extend outwardly from piece 14 or to fold along frame 11.

At the other end frame 11 pivotally engages the free ends of yet another U-shaped carrier 31 provided with support tabs 32 securable to brackets 33 on the upper surface of a weighted bar 25. A bristle strip 26 is then attached to the underside of bar 25.

Concurrently, bar 25 is provided with two nut carriers 27 mounted at the ends of corresponding stand offs 28 which engage threaded shafts 29 fixed to support a felt pad 30 adjacent the strip 26. The vertical deployment of the pad 30 is thus adjustable relative the bristle in strip 26 thereby adjusting the extension of the bristles 26*a* into the interior of grooves G of an escalator stair segment.

Formed along the other side of bar 25 is an elongate nozzle assembly 34 tapering to an outlet 35 for attachment to hose 22. Thus vacuum cleaner 20 when rendered operational in any known manner will develop suction in nozzle 34 to pick up any debris raised by bristles 26*a*. Of course nozzle 34 may include a shielding bristle combination 38 at its exterior for trapping debris for suction removal.

In the foregoing arrangement the wheels of the vacuum together with frame 11 form a dolly easily transportable to the escalator. Once on the escalator arms 17 are used to engage the escalator side surfaces S, the vacuum cleaner is energized, and the carrier 14 is pivoted to place the bristle and pad onto the escalator surface. The weight of the bar 25 then extends and deforms bristles 26*a* to pass into grooves G and thus effects cleaning.

Of course bristles of sufficient stiffness and abrasion resistance are intended, one example thereof being fine stainless steel wire strands of 0.003 to 0.010 inch diameter. The shielding comb bristle on the other hand may be substantially softer, its function being principally to trap the loosened debris.

Obviously many modifications and changes may be made to the foregoing description without departing from the spirit of the invention. It is therefore intended that the scope of the invention be determined solely on the claims appended hereto.

What is claimed is:

1. A sweeper conformed for cleaning the moving surfaces of an escalator comprising:

a frame assembly;

a vacuum cleaner attached to said frame assembly;

a pivoted support structure pivotally mounted at one end of said frame assembly;

a transverse weighting element fixed across said support structure proximate the free end thereof;

a polishing pad mounted on said weighting element and conformed to rest on said moving surfaces of said escalator upon the pivotal deployment of said support structure;

a bristle element attached to said weighting element adjacent said pad; and nozzle means deployed between said pad and said bristle element and connected for suction to said vacuum cleaner.

2. Apparatus according to claim 1 wherein:

said pad and bristle element are substantially equal in transverse dimension to the transverse dimension of said escalator.

3. Apparatus according to claim 2 further comprising:

fixing means attached to said frame for securing thereof adjacent said escalator.

4. Apparatus according to claim 3 further comprising:

wheel means operatively connected to said frame for providing rolling support therefor.

* * * * *